United States Patent [19]

LaVelle et al.

[11] Patent Number: 5,070,542

[45] Date of Patent: Dec. 10, 1991

[54] COLLAR CONSTRUCTION

[75] Inventors: Edward R. LaVelle, Staley; John C. McEwen, Mocksville; Tyler L. Cole, Asheboro; David C. Howell, Clemmons, all of N.C.

[73] Assignee: Sara Lee Corporation, Winston-Salem, N.C.

[21] Appl. No.: 561,199

[22] Filed: Aug. 1, 1990

[51] Int. Cl.[5] ..... A41B 9/06

[52] U.S. Cl. ..... 2/129; 2/113

[58] Field of Search ..... 2/113, 129, 127, 275; 112/418, 419, 167, 169

[56] References Cited

U.S. PATENT DOCUMENTS

| | | | |
|---|---|---|---|
| 42,403 | 4/1864 | Robjohn | 112/419 |
| 44,923 | 11/1864 | Wooster | 112/419 |
| D. 260,445 | 1/1981 | Schreiber | D2/210 |
| D. 269,221 | 7/1983 | Portwood | D2/208 |
| D. 307,506 | 3/1990 | Keates | D2/215 |
| D. 308,438 | 4/1990 | Peart | D2/600 |
| 341,606 | 5/1886 | Rothschild | 2/129 |
| 626,985 | 6/1899 | Deutsch | 2/127 |
| 638,767 | 12/1899 | Sinzheimer | 2/127 |
| 1,403,135 | 1/1922 | Tate | 112/419 |
| 1,427,744 | 8/1922 | Layden | 2/127 |
| 1,481,371 | 1/1924 | Hughes, Jr. | 112/419 |
| 1,575,357 | 3/1926 | Milner | 112/419 |
| 1,936,532 | 11/1933 | Weil | 2/275 |
| 2,011,512 | 8/1935 | Carmichael et al. | 112/419 |
| 2,138,610 | 11/1938 | Overly | 112/419 |
| 2,166,342 | 7/1939 | David | 2/127 |
| 2,256,992 | 9/1941 | Stam | 112/419 |
| 2,275,159 | 3/1942 | Nye, Jr. | 2/275 |
| 2,610,852 | 9/1952 | Ederer | 112/419 |
| 2,728,080 | 12/1955 | Beard | 112/419 |
| 3,281,863 | 1/1964 | Beard | 2/113 |
| 3,296,627 | 11/1965 | Beard | 2/113 |
| 3,303,515 | 2/1967 | Lash | 2/275 |
| 3,449,765 | 6/1969 | Beard et al. | 2/113 |

FOREIGN PATENT DOCUMENTS

| | | | |
|---|---|---|---|
| 624301 | 7/1961 | Canada | 2/129 |
| 22084 | of 1905 | United Kingdom | 2/127 |

OTHER PUBLICATIONS

*U.S. Federal Supply Service, Federal Standard: Stitches, Seams, and Stitches,* Fed. Std. No. 751, Aug. 14, 1959, "Seam type BS-2".

*Primary Examiner*—Peter Nerburn
*Assistant Examiner*—Amy Brook Vanatta
*Attorney, Agent, or Firm*—Rhodes, Coates & Bennett

[57] ABSTRACT

A collar edge construction for a knitted garment. The construction includes a garment body provided with a finished lower edge and sleeves suitably attached opposite side of the upper end of the garment body. The body is cut away in the usual manner at its upper extremity to form a neck opening. The neck opening is visibly framed by a strip of collarette material which is folded longitudinally to form inner and outer layers. The lower portion of the outer layer is preferably folded inwardly to form a folded portion. The lower edge of the inner layer is also preferably folded to form a second folded portion. In accordance with the preferred embodiment, the edge of the body extends upwardly between the layers substantially to the longitudinal fold in the collarette. Preferably, at least two parallel lines of stitching pass through the lower portions of the collarette strip and the body fabric to complete the assembly. Because both edges of the collarette are folded inwardly, no raw edges show. The resulting construction is durable, has a natural tendency to lay flat, and provides an attractive finish in the neck of the garment.

6 Claims, 1 Drawing Sheet

COLLAR CONSTRUCTION

BACKGROUND OF THE INVENTION (1) Field of the Invention

The present invention relates generally to knitted garment construction and, more particularly, to a collarette construction for the neck opening of knitted garments of the slip-over type commonly referred to as T-shirts.

(2) Description of the Prior Art

In the manufacture of T-shirts and related slip-over garments, it is common practice to form the body of the garment from a section of knitted tubular material. A neck opening is cut in the material and this opening is finished by applying to the body of the garment what is normally referred to as a "collarette." The collarette is ordinarily made of a 1×1 rib knit material, the material being passed through a folding machine and doubled back upon itself to provide two layers before being applied to the garment.

As applied to the garment the two layers are disposed on opposite sides of the garment body material, and the free edge of the outer layer is turned under and stitched to the garment so as not to leave a raw edge outwardly of the garment. The lower edge of the inner layer is commonly left with a raw edge. In the past, this inner raw edge is substantially covered by a coverseaming stitch, such as a 406 coverseaming stitch, which attaches the collarette to the garment body.

Such constructions lack a highly desirable finished tailored look. Specifically, the neck line of the garment, when viewed from the outside thereof, does not provide an attractive finish. In addition, such constructions either do not have a natural tenency to lay flat or require additional steps in the manufacturing process in order to cause the collarette to lay flat. Accordingly, current practice is to cover the raw edge by sewing a tape stripe over the seam. However, this technique requires a separate sewing operation be performed which adds cost and increases the opportunity for producing "seconds".

Thus, there remains a need for a new and improved collar construction which is durable, has a natural tendency to lay flat, and provides an attractive finish in the neck of the garment while, at the same time, does not require additional steps in the manufacturing process.

SUMMARY OF THE INVENTION

The present invention is directed to a collar edge construction which includes a garment body provided wit a finished lower edge and sleeves suitably attached opposite side of the upper end of the garment body. The garment body may be formed from any conventional and suitable material, such as flat knit fabric, jersey, etc. The body is cut away in the usual manner at its upper extremity to form a neck opening.

The neck opening is visibly framed by a strip of collarette material which is folded longitudinally to form inner and outer layers. The lower portion of the outer layer is preferably folded inwardly to form a folded portion. The lower edge of the inner layer is also preferably folded to form a second folded portion. In accordance with the preferred embodiment, the edge of the body extends upwardly between the layers substantially to the longitudinal fold in the collarette. Preferably, at least two parallel lines of stitching pass through the lower portions of the collarette strip and the body fabric to complete the assembly. Because both edges of the collarette are folded inwardly, no raw edges show. The resulting construction is durable, has a natural tendency to lay flat, and provides an attractive finish in the neck of the garment.

Accordingly, one aspect of the present invention is to provide a new and improved collar edge construction for a knitted garment. The construction includes: a knitted fabric body portion having an edge defining an opening; a first strip of knitted fabric material having a longitudinally extending first fold therein to form inner and outer layers, said inner and outer layers being disposed on opposite faces of said body portion so as to have said first fold lie substantially parallel to the edge of said body portion; the lower edge portion of said outer layer being folded inwardly upon itself so as to form a second fold extending substantially parallel to said first fold; the lower edge portion of said inner layer being folded inwardly upon itself so as to form a third fold extending substantially parallel to said first and said second folds; and a first row of stitching for fixing said first strip of knitted fabric material to said knitted fabric body portion, wherein said stitching passes successively through said outer layer of said first strip, the inwardly folded portion of said outer layer of said first strip, said fabric body portion, the inwardly folded portion of said inner layer of said first strip, and said inner layer of said first strip.

Another aspect of the present invention is to provide a new and improved garment construction. The garment construction includes: a body of knitted fabric cut away centrally at the top thereof to form a neck opening; a first strip of knitted fabric material having a longitudinally extending first fold therein to form inner and outer layers, said inner and outer layers being disposed on opposite faces of said body portion adjacent to said neck opening so as to have said first fold lie substantially parallel to the edge of said body portion adjacent to said neck opening; the lower edge portion of said outer layer being folded inwardly upon itself so as to form a second fold extending substantially parallel to said first fold; the lower edge portion of said inner layer being folded inwardly upon itself so as to form a third fold extending substantially parallel to said first and said second folds; and at least two rows of stitching for fixing said first strip of knitted fabric material to said knitted fabric body portion, wherein said stitching passes successively through said outer layer of said first strip, the inwardly folded portion of said outer layer of said first strip, said fabric body portion, the inwardly folded portion of said inner layer of said first strip, and said inner layer of said first strip.

These and other aspects of the present invention will become apparent to those skilled in the art after a reading of the following description of the preferred embodiment when considered with the drawings.

DESCRIPTION OF THE PREFERRED EMBODIMENTS

Figure 3:
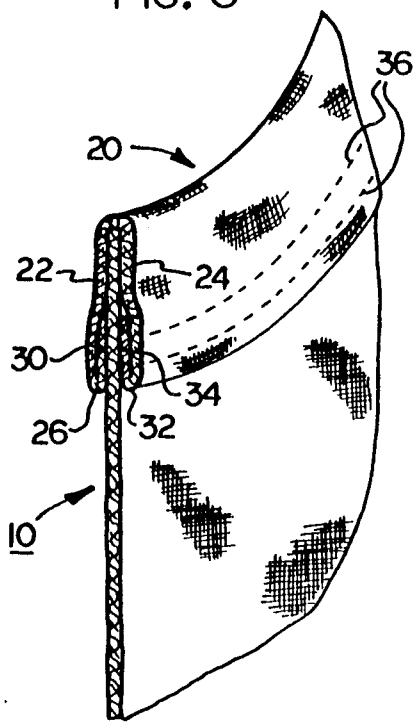
FIG. 3 is an enlarged sectional view of the neck portion of the garment shown in FIGS. 2 and 3, the structure being shown in perspective from the back side of the garment.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
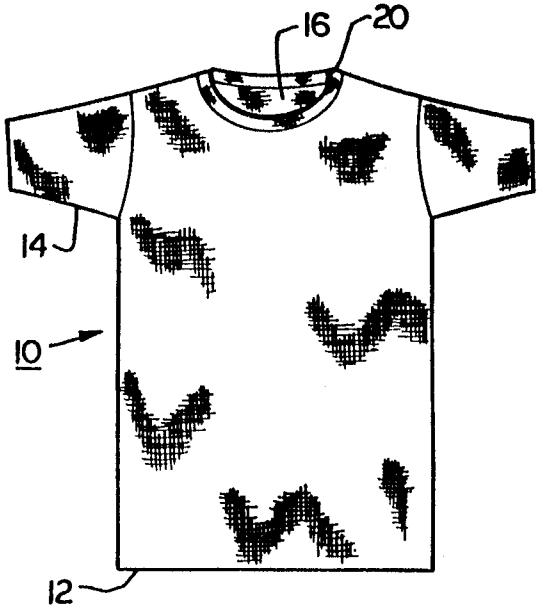
FIG. 1 is a front view of a garment having a neck opening constructed according to the present invention.

Referring now to the drawings in general and FIG. 1 in particular, it will be understood that the illustrations are for the purpose of describing a preferred embodiment of the invention and are not intended to limit the invention thereto. As best seen in FIG. 1, a garment body, generally designated 10, is shown constructed according to the present invention. The garment body may be formed from any conventional and suitable material, such as flat knit fabric, jersey, etc. This material is usually knitted in tubular form and cut into appropriate tubular lengths to form bodies of the individual garments.

The body 10 is provided with a finished lower edge 12 and sleeves 14 are suitably attached opposite side of the upper end of the garment body. The body 10 is cut away in the usual manner at its upper extremity to form a neck opening, generally designated 16. This general manner of construction is conventional.

Figure 2:
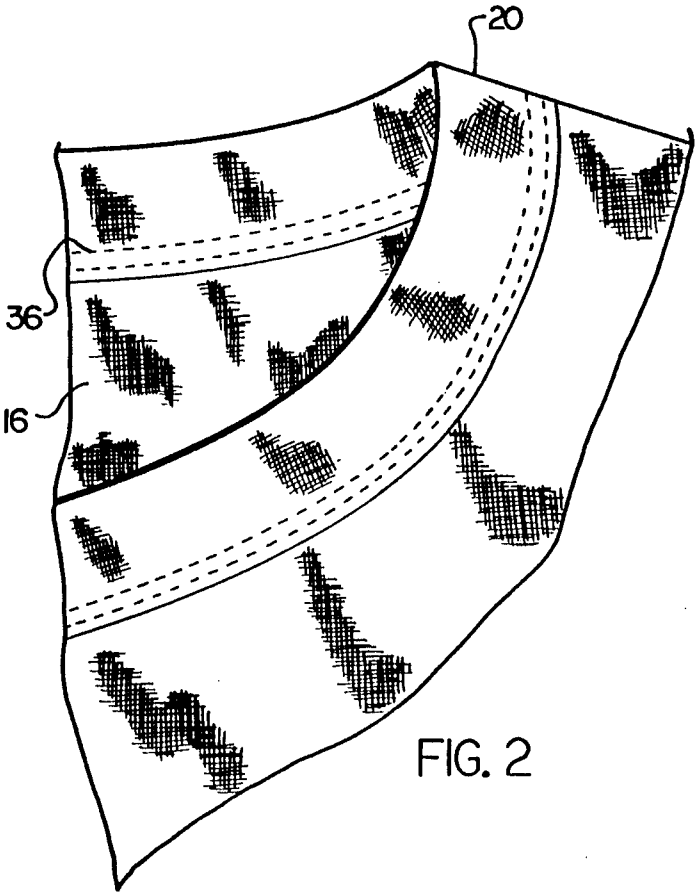
FIG. 2 is an enlarged fragmentary view of the neck portion of the garment shown in FIG. 1.

As best seen in FIG. 2, the neck opening 16 is visibly framed by a strip of collarette material generally designated as 20 which is folded longitudinally to form inner and outer layers 22,24. This collarette material may be of any suitable construction, preferably a 1×1 rib knit fabric being most advantageous in the case of T-shirts.

Turning to FIG. 3, the lower portion of the inner layer 22 is preferably folded inwardly as at 26 to form a folded portion 30. The lower edge of the outer layer 24 is also preferably folded as at 32 to form a second folded portion 34. In accordance with the preferred embodiment, the edge of the body 10 extends upwardly between the layers 22,24 substantially to the longitudinal fold in the collarette 20. Preferably, at least two parallel lines of stitching 36 pass through the lower portions of the collarette strip 20 and the body fabric 10 to complete the assembly. Because both edges of the collarette are folded inwardly, no raw edges show.

In the past it has not been possible to sew two parallel lines of stitching to attach the collarette unless a coverseaming stitch, such as a 406 coverseaming stitch, was used. Thus, two sewing operations would be necessary in order to produce a garment constructed according to the present invention. However, recently experimental sewing machines have been made which permit two parallel rows of 401 double locked stitch to be sewn in a single operation. This advancement in sewing technology makes a garment constructed according to the present invention practical for the first time.

In manufacture, the collarette strip 20 can be folded in a single folding machine applied to the neck opening of the body 10 for subsequential sewing. A convenient type of folding machine utilizes two passages which combine the strip and the fabric body in flat form and a folding section for folding the longitudinal folds of the strip. However, various forms of folding machines will be apparent to those skilled in the art and the particular form which may be adapted forms no part of this invention.

While any of several fabrics can be used to form various components of the complete assembly, the collarette strip 20 is preferably formed from a rib knit fabric. In a particular satisfactory T-shirt construction, the body fabric is a flat knit or jersey construction and the collarette strip fabric is a 1×1 rib knit structure.

Garments employing the instant invention have proved to be very satisfactory in tests and in actual wearing and laundering. The multiple layers of body material and collarette material has exhibited exceptional strength and durability as well as a marked resistance to sagging, collar bulging, or other distortions as the fabric as sandwiched keeps the collarette flat while the parallel rows of stitching provide structural integrity. These layers or folds serve also apparently to absorb the strain on seams which normally are caused by use and laundering.

It will be apparent also that the improved functional features have been achieved with an improvement in the outward appearance of the garment. Finally, it will be apparent that the assembly of the present invention can be manufactured without substantial additional expenses and no additional sewing operations are required.

Certain modifications and improvements will occur to those skilled in the art upon reading of the foregoing description. By way of example, the strip of collarette material could be of the seamless "knit-to-size" type which eliminates the shoulder seam passing through the collar portion of the shirt. It should be understood that all such modifications and improvements have been deleted herein for the sake of conciseness and readability but are properly within the scope of the following claims.

We claim:

1. A collar edge construction for a knitted garment comprising:

(a) a knitted fabric body portion having an edge defining an opening;

(b) a first strip of knitted fabric material having a longitudinally extending first fold therein to form inner and outer layers, said inner and outer layers being disposed on opposite faces of said body portion so as to have said first fold lie substantially parallel to the edge of said body portion;

(c) the lower edge portion of said outer layer being folded inwardly upon itself so as to form a second fold extending substantially parallel to said first fold;

(d) the lower edge portion of said inner layer being folded inwardly upon itself so as to form a third fold extending substantially parallel to said first and said second folds;

(e) a first row of chain stitching for fixing said first strip of knitted fabric material to said knitted fabric body portion, wherein said stitching passes successively through said outer layer of said first strip, the inwardly folded portion of said outer layer of said first strip, said fabric body portion, the inwardly folded portion of said inner layer of said first strip, and said inner layer of said first strip; and (f) a second row of chain stitching, unconnected to said first row, and adjacent to and substantially parallel to said first row of stitching for fixing said first strip of knitted fabric material to said knitted fabric body portion, wherein said second row of stitching passes successively through said outer layer of said first strip, the inwardly folded portion of said outer layer of said first strip, said fabric body portion, the inwardly folded portion of said inner layer of said first strip, and said inner layer of said first strip.

2. The collar edge construction according to claim 1, wherein the edge of said fabric body portion lies adjacent to said first fold.

3. The collar edge construction according to claim 1, wherein said first strip is formed of fabric which is relatively elastic in the direction of said first fold.

4. The collar edge construction according to claim 3, wherein said first strip is formed from a rib knit fabric.

5. The collar edge construction according to claim 1, wherein said body is formed from a flat knitted fabric and said first strip if formed form a 1×1 rib knit fabric.

6. A garment construction comprising:

(a) a body of knitted fabric cut away centrally at the top thereof to form a neck opening;

(b) a first strip of knitted fabric material having a longitudinally extending first fold therein to form inner and outer layers, said inner and outer layers being disposed on opposite faces of said body portion adjacent to said neck opening so as to have said first fold lie substantially parallel to the edge of said body portion adjacent to said neck opening;

(c) the lower edge portion of said outer layer being folded inwardly upon itself so as to form a second fold extending substantially parallel to said first fold;

(d) the lower edge portion of said inner layer being folded inwardly upon itself so as to form a third fold extending substantially parallel to said first and said second folds; and (e) at least two rows of unconnected, substantially parallel chain stitching for fixing said first strip of knitted fabric material to said knitted fabric body portion, wherein said stitching passes successively through said outer layer of said first strip, the inwardly folded portion of said outer layer of said first strip, said fabric body portion, the inwardly folded portion of said inner layer of said first strip, and said inner layer of said first strip.

* * * * *